US011569571B2

(12) United States Patent
Chang et al.

(10) Patent No.: US 11,569,571 B2
(45) Date of Patent: Jan. 31, 2023

(54) MOBILE DEVICE

(71) Applicant: Acer Incorporated, New Taipei (TW)

(72) Inventors: Kun-Sheng Chang, New Taipei (TW); Ching-Chi Lin, New Taipei (TW)

(73) Assignee: ACER INCORPORATED, New Taipei (TW)

( * ) Notice: Subject to any disclaimer, the term of this patent is extended or adjusted under 35 U.S.C. 154(b) by 130 days.

(21) Appl. No.: 17/200,968

(22) Filed: Mar. 15, 2021

(65) Prior Publication Data

US 2022/0123463 A1 Apr. 21, 2022

(30) Foreign Application Priority Data

Oct. 20, 2020 (TW) ..... 109136239

(51) Int. Cl.

| | |
|---|---|
| ***H01Q 1/52*** | (2006.01) |
| ***H01Q 1/24*** | (2006.01) |
| ***H01Q 5/307*** | (2015.01) |
| ***H01Q 9/42*** | (2006.01) |
| *H01Q 1/22* | (2006.01) |

(52) U.S. Cl.

CPC ..... *H01Q 1/52* (2013.01); *H01Q 1/243* (2013.01); *H01Q 5/307* (2015.01); *H01Q 9/42* (2013.01); *H01Q 1/2258* (2013.01)

(58) Field of Classification Search

CPC ..... H01Q 1/2258; H01Q 9/42; H01Q 1/243; H01Q 5/307; H01Q 1/52

See application file for complete search history.

*Primary Examiner* — Graham P Smith

(74) *Attorney, Agent, or Firm* — Edell, Shapiro & Finnan, LLC

(57) ABSTRACT

An antenna for a mobile device includes a ground element, a substrate disposed over the ground element, a first radiating element having a feedpoint, a second radiating element coupled to the ground element and adjacent the first radiating element, and a connection metal element disposed on the substrate, and a coaxial cable, having central conductor coupled to the feedpoint, a shielding conductor, and an insulating outer layer, wherein the shielding conductor has a bare region, spaced from the feedpoint, that exposes a portion of the shielding conductor, and the portion of the shielding conductor is coupled through the connection metal element to the second radiating element.

20 Claims, 7 Drawing Sheets

300

MOBILE DEVICE

This application claims the benefit of Taiwan Application Serial No. 109136239, filed Oct. 20, 2020, the subject matter of which is incorporated herein by reference.

TECHNICAL FIELD

The present invention is related to a mobile device, and more particularly to an antenna structure to provide wireless communication for the mobile device.

BACKGROUND

With the development of mobile communication technology, mobile devices have become increasingly common in recent years. Examples of mobile devices include, among others, portable computers, mobile phones, multimedia players, and other multi-function portable electronic products. In order to meet consumer demand, mobile devices usually provide wireless communication functions. Some communication functions cover a relatively long-distance wireless communication range. For example, mobile phones may use 2G, 3G, and LTE (Long Term Evolution) systems that rely on the 700 MHz, 850 MHz, 900 MHz, 1800 MHz, 1900 MHz, 2100 MHz, 2300 MHz, and 2500 MHz frequency bands.

To cover relatively shorter-distance wireless communication ranges, a mobile device might rely on Wi-Fi and Bluetooth systems that operate in the 2.4 GHz, 5.2 GHz, and 5.8 GHz frequency bands (i.e., for wireless local area network (WLAN) operations).

To support the aforementioned types of wireless communications, an antenna is disposed in the mobile device. Unfortunately, the antenna can be affected by adjacent metal components of the mobile device, resulting in undesirable interference and reduced overall communication quality. It is in this context that the embodiments of the present invention are disclosed.

SUMMARY

Embodiments of the present invention provide an antenna for a mobile device. the anteanna includes a ground element, a substrate disposed over the ground element, a first radiating element having a feedpoint, a second radiating element coupled to the ground element and adjacent the first radiating element, and a connection metal element disposed on the substrate, and a coaxial cable, having central conductor coupled to the feedpoint, a shielding conductor, and an insulating outer layer, wherein the shielding conductor has a bare region, spaced from the feedpoint, that exposes a portion of the shielding conductor, and the portion of the shielding conductor is coupled through the connection metal element to the second radiating element.

In another the invention provides an antenna for a mobile device. The antenna includes a substrate having a first portion and a second portion, a ground element that is coextensive only with the first portion of the substrate, a first radiating element disposed on the first portion of the substrate, a second radiating element disposed on the first portion of the substrate, adjacent the first radiating element, and coupled to the ground element; a connection metal element disposed on the second portion of the substrate and having a first end and a second end, the second end being connected to the second radiating element at a border region between the first portion of the substrate and the second portion of the substrate; and a coaxial cable having a central conductor and a shielding conductor, the central conductor being connected to a feedpoint of the first radiating element and the shielding conductor being connected to the first end of the connection metal element in the second portion of the substrate via a bare region of the coaxial cable that exposes a segment of the shielding conductor.

The disclosed embodiments can reduce unstable radio amplitude across a wireless spectrum.

BRIEF DESCRIPTION OF THE DRAWINGS

Embodiments are described herein in conjunction with the accompanying drawings, in which.

DESCRIPTION OF EXAMPLE EMBODIMENTS

Figure 1:
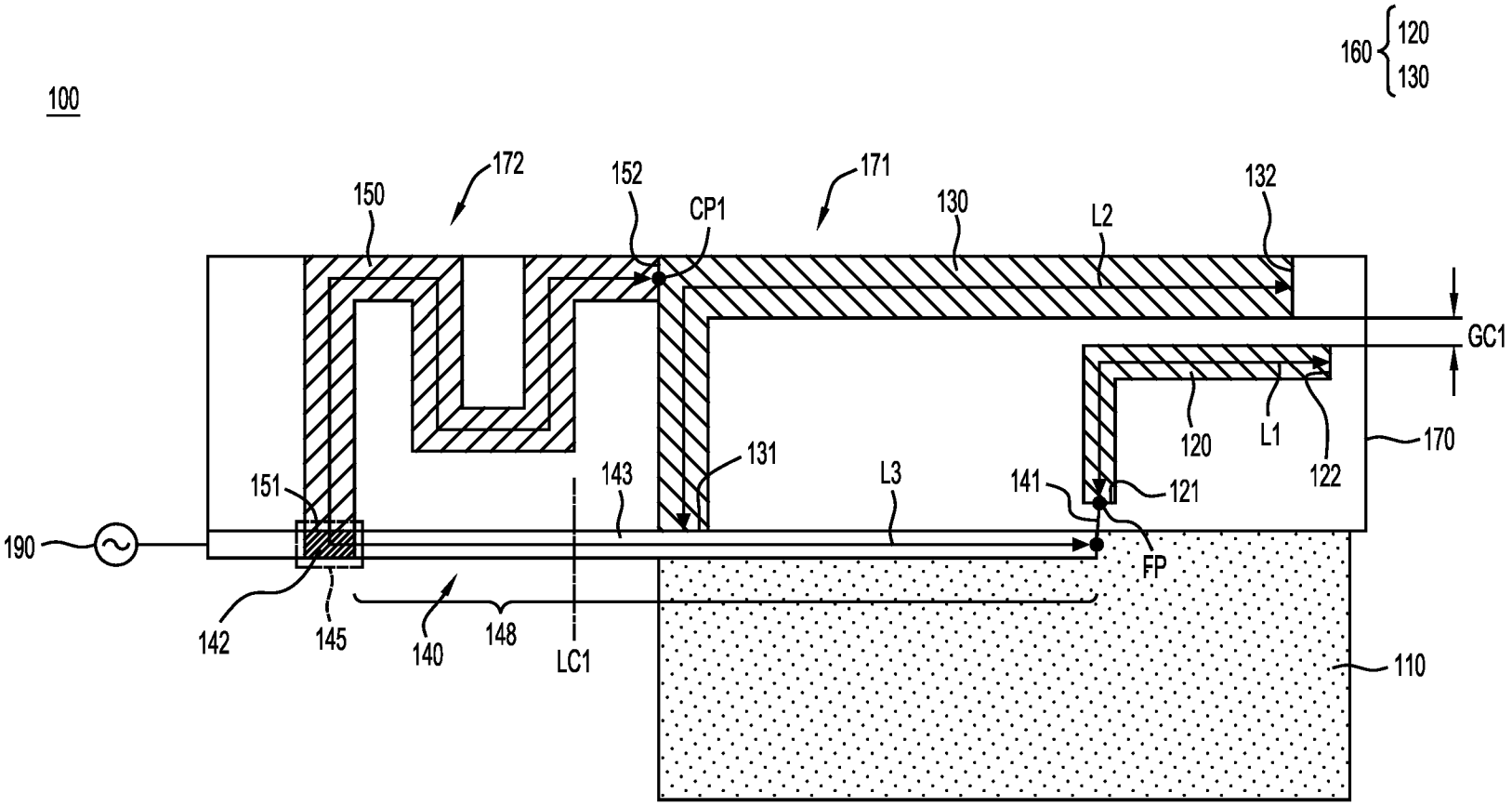
FIG. 1 is a schematic diagram showing an antenna for a mobile device according to an example embodiment of the present invention.

FIG. 1 is a schematic diagram showing an antenna for a mobile device according to an example embodiment of the present invention. The mobile device 100 can be a smart phone, a tablet computer, or a notebook computer, among other possible devices. As shown, the mobile device 100 includes a ground element 110, a first radiating element 120, a second radiating element 130, a coaxial cable 140, a metal connection element 150, and a dielectric substrate 170. The ground element 110, first radiating element 120, and second radiating element 130 are all made of conductive (e.g., metal) material.

The ground element 110 may be implemented with a ground copper foil and may be coupled to a system grounding plane (not shown) of the mobile device 100.

The first radiating element 120 may generally exhibit a relatively shorter L-shape. More specifically, the first radiating element 120 includes a first-end 121 and a second-end 122. A feed point FP is disposed at the first-end 121 of the first radiating element 120. The second-end 122 of the first radiating element 120 is an open-end.

The second radiating element 130 may generally exhibit a relatively longer L-shape. More specifically, the second radiating element 130 includes a first-end 131 and a second-end 132. The first-end 131 of the second radiating element 130 is coupled to the ground element 110, and the second-end 132 of the second radiating element 130 is an open-end. The second-end 132 of the second radiating element 130 and the second-end 122 of the first radiating element 120 may extend substantially in the same direction. The second radiating element 130 is adjacent to the first radiating element 120 and, at least with respect to corresponding segments, define a coupling gap GC1 between the second-end 132 of the second radiating element 130 and the second-end 122 of the first radiating element 120. Those skilled in the art will appreciate that the term "adjacent" in this context means that the distance between the corresponding two segments is less than a fixed distance (e.g., 5 mm or less), but usually does not include direct contact between the two corresponding elements. In a preferred embodiment, the first radiating element 120 and the second radiating element 130 together form an antenna structure 160 of the mobile device 100 that can be excited by a signal source 190. For example, the signal source 190 may be a radio frequency (RF) module, which has an anode and a cathode.

In some embodiments, the antenna structure 160 of the mobile device 100 may cover a first frequency band and a second frequency band. For example, the aforementioned first frequency band may be between 2400 MHz and 2500 MHz, and the aforementioned second frequency band may be between 5150 MHz and 5850 MHz. Therefore, the antenna structure 160 of the mobile device 100 is configured to at least support WLAN (Wireless Wide Area Network) 2.4 GHz/5 GHz broadband operations.

Figure 2:
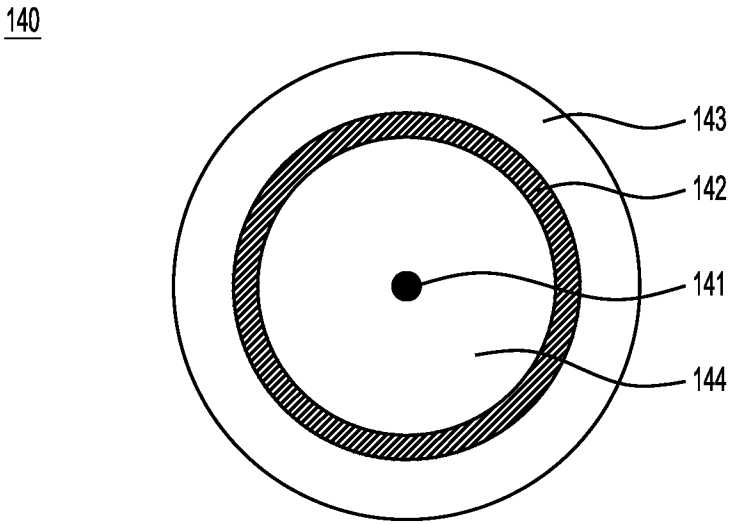
FIG. 2 shows a cross-sectional view of a coaxial cable that is used in connection with an example embodiment of the present invention.

FIG. 2 shows a cross-sectional view along line LC1 in FIG. 1 of coaxial cable 140 according to an embodiment of the present invention.

Still with reference to FIG. 1, the coaxial cable 140 of FIG. 2 includes a central conductor 141, a shielding conductor 142, and an insulation outer layer 143. The positive pole or anode of the signal source 190 can be connected to the feed point FP via the central conductor 141, and the negative pole or cathode of the signal source 190 can be connected to the shielding conductor 142.

The shielding conductor 142 is at least partially covered by an insulating outer layer 143. In some embodiments, the coaxial cable 140 further includes a dielectric layer 144, and the dielectric layer 144 is disposed between the central conductor 141 and the shielding conductor 142. In an embodiment, the coaxial cable 140 is arranged to have a bare region 145 (FIG. 1), i.e., the bare region 145 is stripped such that there is no insulation outer layer 143 located in the bare region 145. That is, the shielding conductor shell 142 is exposed in the bare area 145. In some embodiments, the bare region 145 is located away from the ground element 110.

Still with reference to FIG. 1, the metal connection element 150 may generally exhibit a meandering shape, which may include one or more U-shaped portions connected to each other. More specifically, the metal connection element 150 has a first-end 151 and a second-end 152, wherein the first-end 151 of the metal connection element 150 is connected to the shielding conductor 142 via the bare region 145, and the second-end 152 of metal connection element 150 is connected to a connection point CP1 on the second radiating element 130. For example, the connection point CP1 may be located at a right angle bend area of the second radiating element 130. Therefore, the shielding conductor 142 in the bare region 145 can be connected to the second radiating element 130 via the metal connection element 150. Those skilled in the art will appreciate that, except for the bare region 145, the rest of the shielding conductor 142 does not directly contact the ground element 110 (because it is separated by the insulation outer layer 143).

Thus, as illustrated in FIG. 1, the dielectric substrate 170 may have a first portion 171 and a second portion 172, and the ground element 110 is coextensive only with the first portion 171 of the dielectric substrate 170. That is, a border between the first portion 171 and the second portion 172 of the dielectric substrate 170 may be defined by a segment of the second radiating element 130, or an edge of the ground element 110. The first radiating element 120 is disposed on the first portion 171 of the dielectric substrate 170 and the second radiating element 130 is also disposed on the first portion 171 of the dielectric substrate 170, adjacent the first radiating element 120.

The connection metal element 150 is disposed on the second portion 172 of the dielectric substrate 170 (which, as noted, may not be co-extensive with the ground element 110). The connection metal element has a first-end 151 and a second-end 152. As will be explained below, the first-end 151 is connected to the shielding conductor 142 of the coaxial cable 140, and the second-end 152 is connected to the second radiating element 130 at the border between the first portion 171 of the dielectric substrate 170 and the second portion 172 of the dielectric substrate 170.

The dielectric substrate 170 can be an FR4 (Flame Retardant 4) substrate, a printed circuit board (PCB), or a flexible circuit board (FCB), wherein the first radiating element 120 and the second radiating element 130 and the metal connection element 150 can be disposed on the same surface of the dielectric substrate 170.

Figure 7:
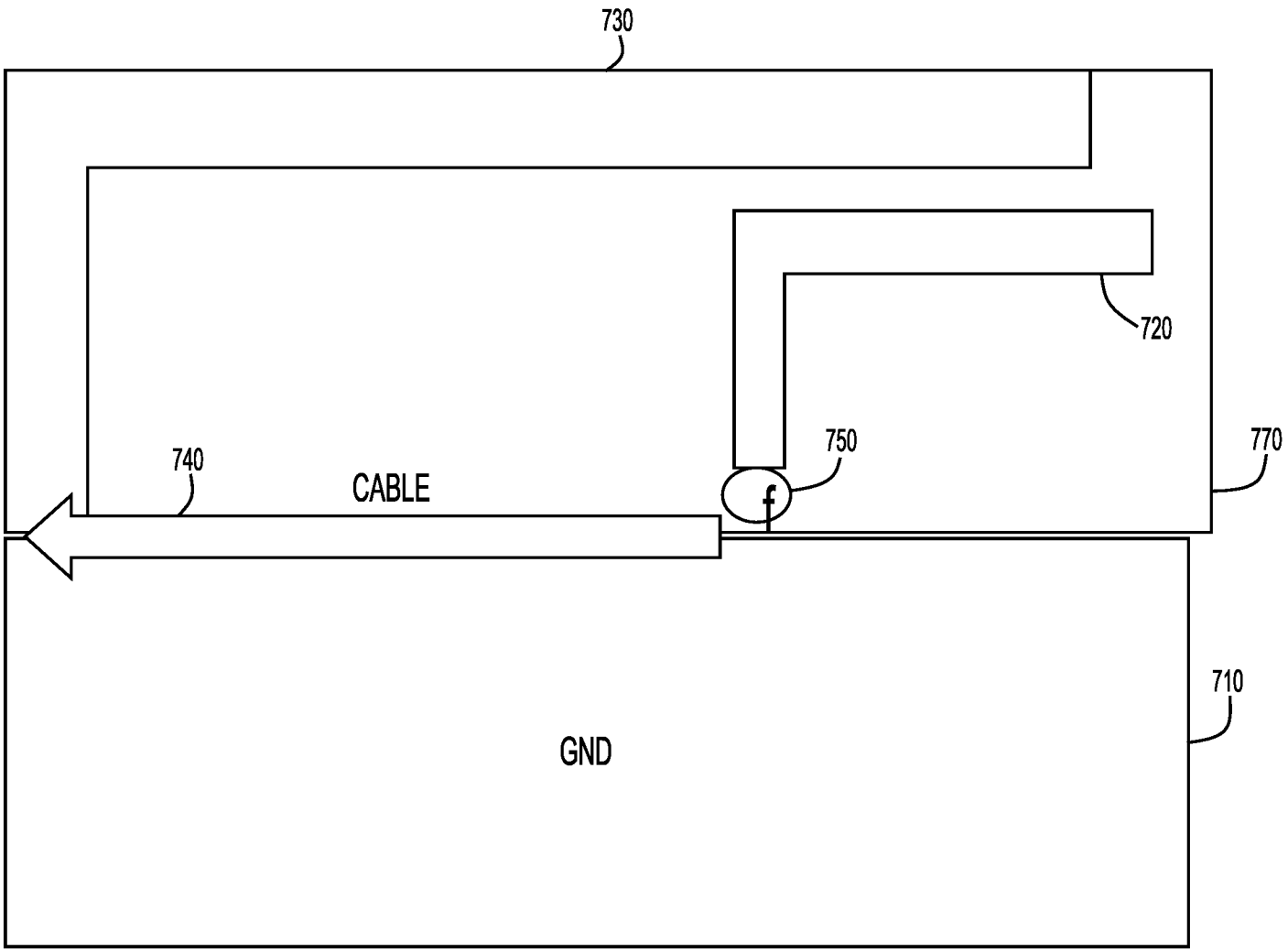
FIG. 7 is a schematic diagram showing an antenna for a mobile device according to the prior art.

Reference is now made to FIG. 7, which is a schematic diagram showing an antenna for a mobile device according to the prior art. As shown, a first radiating element 720 and a second radiating element 730 are disposed on a substrate 770, and a ground element 710 is provided. A coaxial cable 740 extends towards, and is connected at, a feedpoint 750. Among other differences compared to the antenna structure 160 illustrated in FIG. 1, is that the prior art antenna of FIG. 7 does not include a bare region 145, a metal connection element 150 (including, possibly, a meandering trace with at least one U-shaped portion), or a ground element that does not extend the length of the substrate 770.

Figure 3:
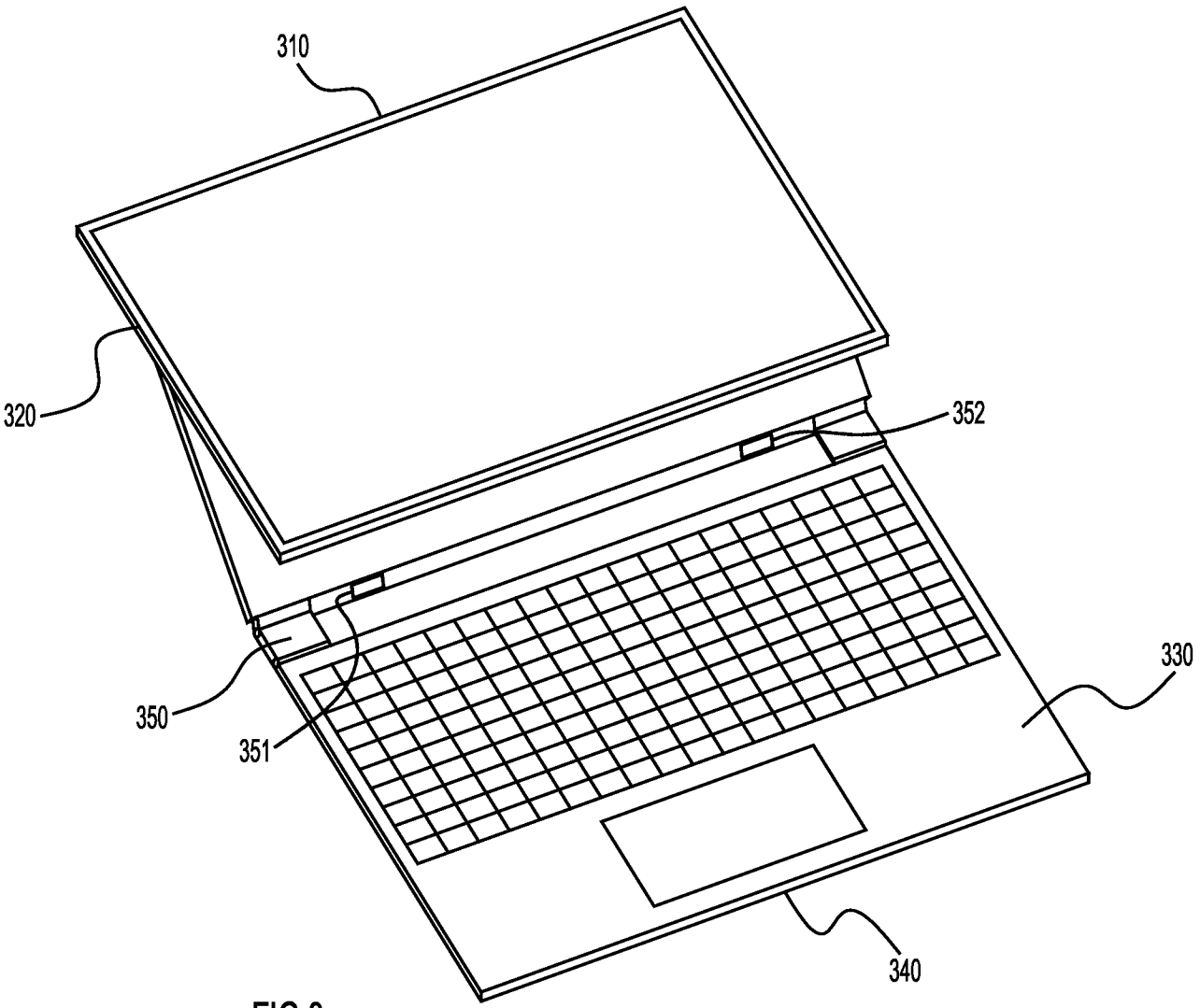
FIG. 3 shows a schematic diagram of a notebook computer according to an example embodiment of the invention.

FIG. 3 shows a schematic diagram of a notebook computer according to an example embodiment of the invention. In the embodiment of FIG. 3, the aforementioned antenna structure 160 can be applied to a notebook computer 300, where the notebook computer 300 includes an upper cover housing 310, a display frame 320, a keyboard frame 330, a base housing 340, and a hinge element 350. Those skilled in the art will appreciate that the upper cover housing 310, the display frame 320, the keyboard frame 330, and the base housing 340 are respectively equivalent to an "A part", "B part", "C part", and "D part", which is nomenclature commonly used in the field of notebook computers.

The aforementioned antenna structure 160 can be disposed at a first position 351 and/or a second position 352 of the notebook computer 300 and adjacent to the hinge element 350. In some embodiments, the notebook computer 300 is a convertible mobile device, which can operate in a notebook mode, a tablet mode, or a sharing mode (FIG. 3 illustrates shows the sharing mode). In order to maximize the display area, the hinge element 350 of the notebook computer 300 can be implemented with a sunken design.

Figure 4:
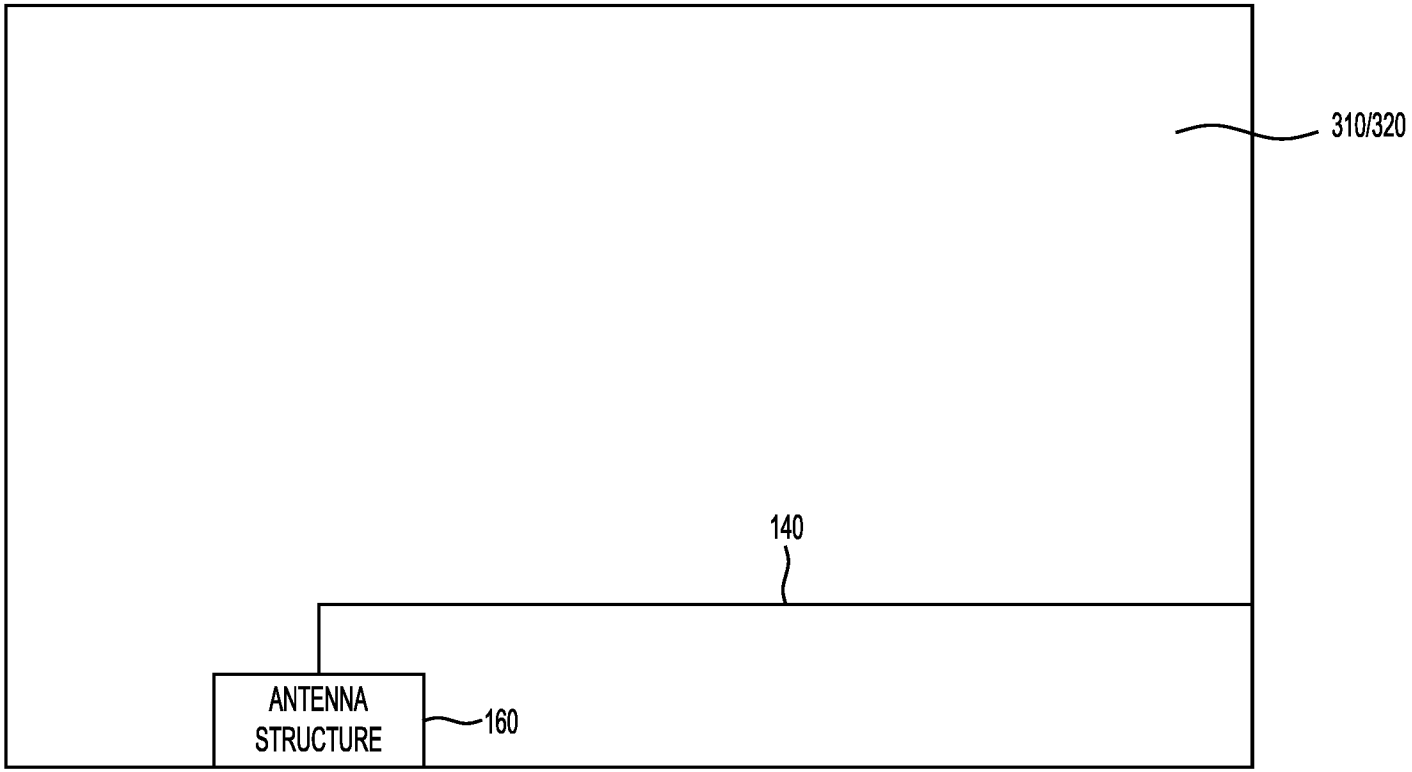
FIG. 4 is a schematic diagram showing the antenna structure applied to a notebook computer according to an example embodiment of the invention.

FIG. 4 is a schematic diagram showing the antenna structure 160 applied to the notebook computer 300 according to an embodiment of the invention. If the antenna structure 160 is used as an auxiliary antenna (i.e., it is paired with a primary antenna), the corresponding coaxial cable 140 may have to extend farther than desired (i.e., across a substantial portion of the notebook computer 300/310/320). Such an extended length can result in unintended resonance and cause undesirable interference.

Figure 5:
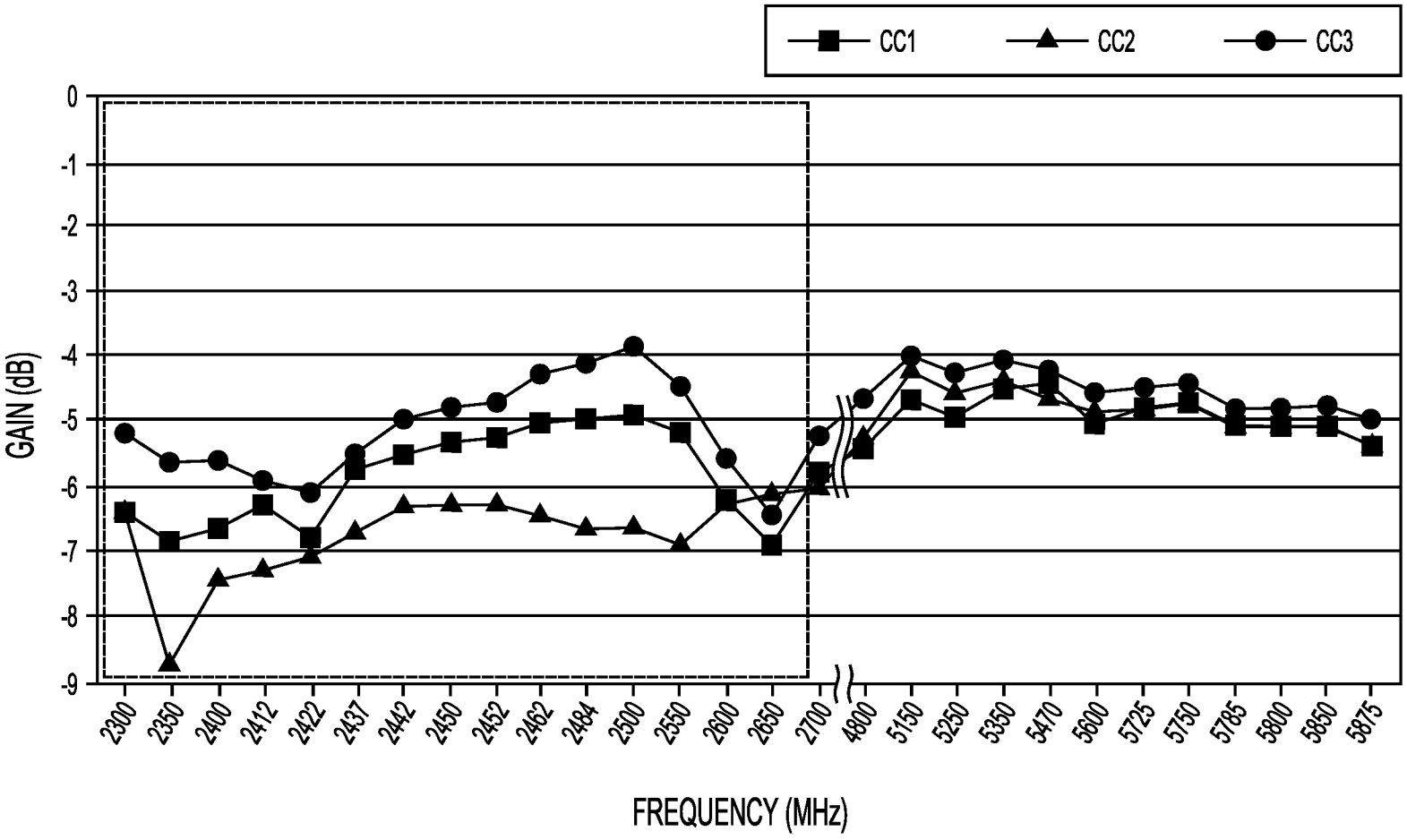
FIG.5 PRIOR ART
FIG. 5 shows a radiation gain chart showing the radiation gain of a prior art antenna structure of a mobile device like that shown in FIG. 7.

FIG. 5 shows a radiation gain chart showing the radiation gain of the prior art antenna structure of a mobile device like that shown in FIG. 7. In the figure, the horizontal axis represents the operating frequency (MHz) and the vertical axis represents the radiation gain (dB). As shown, a first curve CC1 represents the radiation gain of the prior art antenna structure of the mobile device in notebook mode, a second curve CC2 represents the radiation gain of the prior art antenna structure of the mobile device in the tablet mode, and a third-curve CC3 represents the radiation gain of the prior art antenna structure of the mobile device in the shared mode.

According to the measurement results in FIG. 5, it can be seen that the prior art antenna structure of the mobile device may have unstable radiation gain because the corresponding coaxial cable is too long and causes undesirable interference. More specifically, FIG. 5 shows a reduced radiation gain in the first frequency band.

Figure 6:
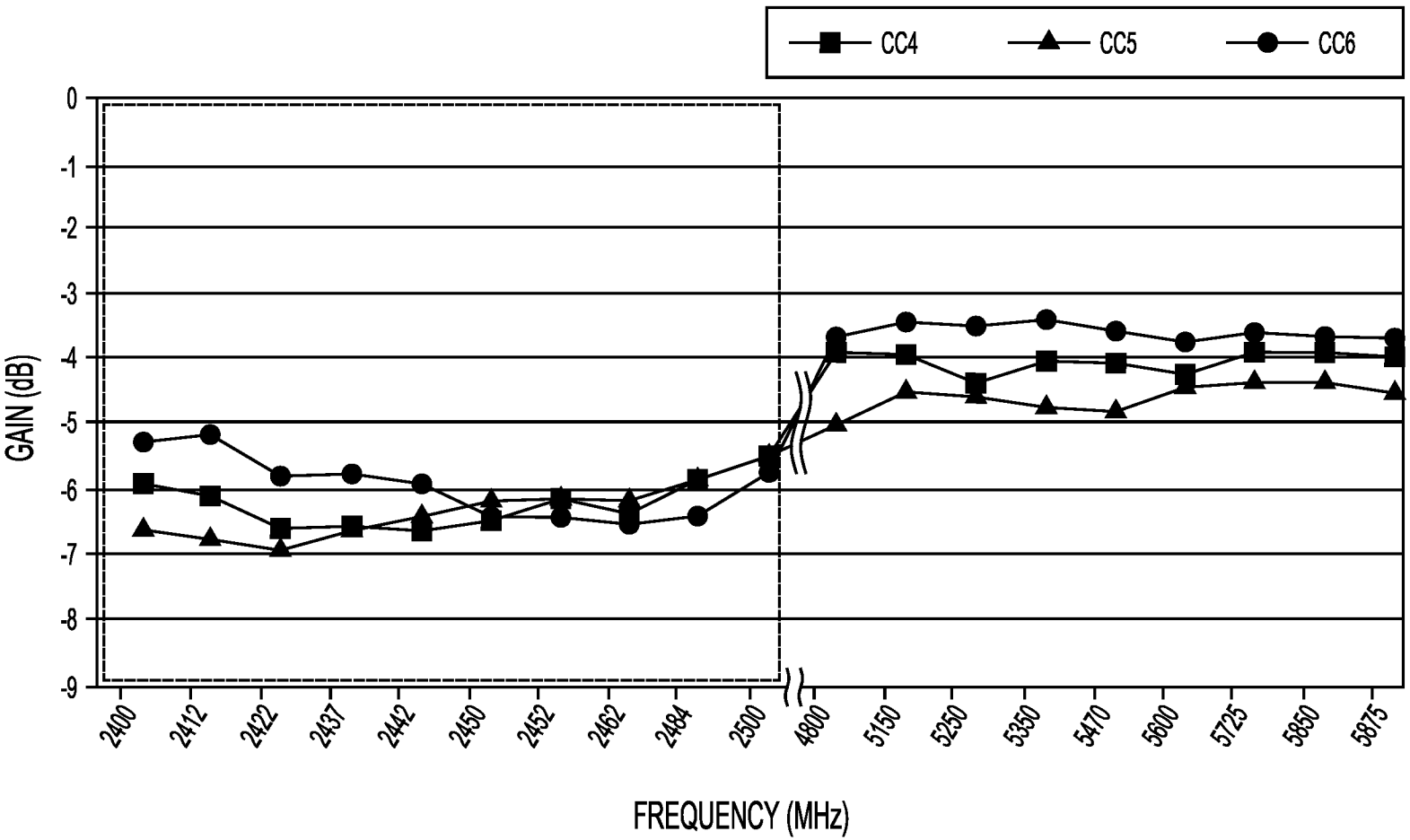
FIG. 6 is a radiation gain chart showing the radiation gain of the antenna structure of the mobile device according to an example embodiment of the invention.

FIG. 6 is a radiation gain chart showing the radiation gain of the antenna structure 160 of the mobile device 100 according to an example embodiment of the invention. In the figure, the horizontal axis represents the operating frequency (MHz) and the vertical axis represents the radiation gain (dB). As shown, a fourth curve CC4 represents the radiation gain of the antenna structure 160 of the mobile device 100 in notebook mode, a fifth curve CC5 represents the radiation gain of the antenna structure 160 of the mobile device 100 in the tablet mode, and a sixth curve CC6 represents the radiation gain of the antenna structure 160 of the mobile device 100 in the sharing mode.

According to the measurement results in FIG. 6, when the shielding conductor 142 in the bare region 145 is connected to the ground element 110 via the connection metal portion 150 and the second radiating portion 130, it can effectively prevent the coaxial cable 140 from interacting with the antenna structure 160 and causing radiation efficiency instability. Additionally, regardless of whether the mobile device 100 is operating in the notebook mode, tablet mode, or shared mode, the radiation gain of the antenna structure 160 in the aforementioned first frequency band remains stable. An antenna design according to the present invention is therefore very suitable for applications in various communication environments (especially when the coaxial cable 140 feeding the antenna is relatively long).

In some embodiments, the component dimensions of the mobile device 100 can be as follows. The length L1 of the first radiating element 120 may be approximately equal to 0.25 times the wavelength ($\lambda/4$) of the second frequency band of the antenna structure 160 of the mobile device 100. The length L2 of the second radiating element 130 may be approximately equal to 0.25 times the wavelength ($\lambda/4$) of the first frequency band of the antenna structure 160 of the mobile device 100. The width of the coupling gap GC1 can be less than or equal to 1 mm. A specific section 148 of the coaxial cable 140 is defined as a part between the bare region 145 and the feed point FP, wherein the total length L3 of the specific section 148 and the connection metal portion 150 may be approximately equal to 0.5 times the wavelength ($\lambda/2$) of the first frequency band of the antenna structure 160 of the mobile device 100. The range of the above element size is based on the results of many experiments to optimize the radiation stability of the antenna structure 160 of the mobile device 100, the operation bandwidth, and impedance matching.

The present invention proposes a novel mobile device and antenna structure. Compared with the prior art design, the present invention at least has the advantages of wide frequency band, low manufacturing cost, higher radiation gain, and better radiation stability, so it is very suitable for various applications of all types of mobile communication devices.

It should be noted that the above-mentioned component size, component shape, and frequency range are not the limiting conditions of the present invention. One skilled in the art can adjust these settings according to different needs. The mobile device and antenna structure of the present invention are not limited to the configurations shown in FIGS. 1-4 and 6. The present invention may include any one or more of the features of any one or more of the embodiments in FIGS. 1-4 and 6. In other words, not all the features of the illustrations need to be implemented in the mobile device and the antenna structure of the present invention.

That is, the above description is intended by way of example only.

What is claimed is:

1. An antenna for a mobile device, the antenna comprising:

a ground element;

a substrate disposed over the ground element;

a first radiating element having a feedpoint, a second radiating element coupled to the ground element and adjacent the first radiating element, and a connection metal element disposed on the substrate; and a coaxial cable, having central conductor coupled to the feedpoint, a shielding conductor, and an insulating outer layer, wherein the shielding conductor has a bare region, spaced from the feedpoint, that exposes a portion of the shielding conductor, and the portion of the shielding conductor is coupled through the connection metal element to the second radiating element.

2. The antenna of claim 1, wherein the first radiating element is L-shaped.

3. The antenna of claim 1, wherein the second radiating element is L-shaped.

4. The antenna of claim 3, wherein the connection metal element is connected to the second radiating element at a right angle bend area of the second radiating element.

5. The antenna of claim 1, wherein the connection metal element includes at least one U-shaped portion.

6. The antenna of claim 1, wherein the antenna is tuned for operation in a first frequency band and a second frequency band.

7. The antenna of claim 6, wherein the first frequency band comprises approximately 2400 MHz to 2500 MHz, and the second frequency band comprises approximately 5150 MHz to 5850 MHz.

8. The antenna of claim 7, wherein a sum of a length of the coaxial cable between the feedpoint and the portion of the shielding conductor and a length of the connection metal element is approximately equal to one half wavelength of the first frequency band.

9. The antenna of claim 8, wherein a length of the first radiating element is approximately equal to one quarter wavelength of the second frequency band.

10. The antenna of claim 8, wherein a length of the second radiating element is approximately equal to one quarter wavelength of the first frequency band.

11. The antenna of claim 1, wherein the antenna is an auxiliary antenna, paired with a primary antenna, and disposed in the mobile device.

12. An antenna for a mobile device, the antenna comprising:

a substrate having a first portion and a second portion;

a ground element that is coextensive only with the first portion of the substrate;

a first radiating element disposed on the first portion of the substrate;

a second radiating element disposed on the first portion of the substrate, adjacent the first radiating element, and coupled to the ground element;

a connection metal element disposed on the second portion of the substrate and having a first end and a second end, the second end being connected to the second radiating element at a border region between the first portion of the substrate and the second portion of the substrate; and a coaxial cable having a central conductor and a shielding conductor, the central conductor being connected to a feedpoint of the first radiating element and the shielding conductor being connected to the first end of the connection metal element in the second portion of the substrate via a bare region of the coaxial cable that exposes a segment of the shielding conductor.

13. The antenna of claim 12, wherein the coaxial cable extends over both the first portion of the substrate and the second portion of the substrate.

14. The antenna of claim 12, wherein the first radiating element is L-shaped.

15. The antenna of claim 12, wherein the second radiating element is L-shaped.

16. The antenna of claim 15, wherein the second end of the connection metal element is connected to the second radiating element at a right angle bend area of the second radiating element.

17. The antenna of claim 12, wherein the connection metal element includes at least one U-shaped portion.

18. The antenna of claim 12, wherein the antenna is tuned for operation in a first frequency band and a second frequency band.

19. The antenna of claim 18, wherein the first frequency band comprises approximately 2400 MHz to 2500 MHz, and the second frequency band comprises approximately 5150 MHz to 5850 MHz.

20. The antenna of claim 18, wherein a sum of a length of the coaxial cable between the feedpoint and the first end of the connection metal element and a length of the connection metal element is approximately equal to one half wavelength of the first frequency band.

* * * * *